United States Patent [19]

Davidian et al.

[11] Patent Number: 5,060,991

[45] Date of Patent: Oct. 29, 1991

[54] DOOR LATCH ASSEMBLY WITH RACK AND PINION ACTUATING MEMBERS

[75] Inventors: Richard M. Davidian, Kensington; Oakley W. Mickle, Rockfall, both of Conn.

[73] Assignee: Emhart Inc., Newark, Del.

[21] Appl. No.: 425,151

[22] Filed: Oct. 20, 1989

[51] Int. Cl.[5] ..... E05C 1/16

[52] U.S. Cl. ..... 292/172; 70/149; 272/DIG. 27; 272/280

[58] Field of Search ..... 272/DIG. 27, 112, 160, 272/142, 179, 172, 279, 280, 51; 70/149, 107, 472

[56] References Cited

U.S. PATENT DOCUMENTS

| | | | |
|---|---|---|---|
| 655,476 | 8/1990 | Carleton | 292/172 |
| 656,011 | 8/1900 | Carleton | 292/172 |
| 1,102,313 | 7/1914 | Yates et al. | 292/172 |
| 1,511,956 | 10/1924 | Flagg | 70/149 |
| 1,964,066 | 6/1934 | Kuszmaul | 292/DIG. 27 |
| 1,968,285 | 7/1934 | Egan | 292/172 |
| 2,021,565 | 11/1935 | Merideth et al. | 70/149 |
| 2,178,530 | 10/1939 | Rightmyer | 292/172 |
| 3,561,805 | 2/1971 | Shaw | 292/172 |
| 3,933,016 | 1/1976 | Nolin | 70/149 |
| 4,052,092 | 10/1977 | Bergen | 292/172 |
| 4,384,465 | 5/1983 | Muus | 292/172 |
| 4,725,085 | 2/1988 | Hu et al. | 292/172 |
| 4,934,800 | 6/1990 | Choi | 292/172 |

FOREIGN PATENT DOCUMENTS

| | | | |
|---|---|---|---|
| 413637 | 5/1946 | Italy . | |
| 24485 | of 1909 | United Kingdom | 292/172 |

*Primary Examiner*—Eric K. Nicholson

*Attorney, Agent, or Firm*—J. Bruce Hoofnagle

[57] ABSTRACT

A door latch assembly 10 includes a rack 102 which is moved upon depression of a thumbpiece 12. Movement of the rack 102 results in rotation of an enmeshed pinion 136 and an assembled spindle 152. As the spindle 152 rotates, a latch 26 is moved from a latched position to an unlatched position to thereby permit opening of a door 20 on which the door latch assembly is mounted.

When it is desired to lock the door 20, a key-operated lock cylinder 16 is operated to place into motion facilities for moving the rack 102 into a disabled poisition whereafter depression of the thumbpiece 12 will not result in movement of the rack.

As the rack 102 is moved to the disabled position, teeth 104 of the rack remain enmeshed with teeth 138 of pinion 136. When the rack 102 is again moved to the enabled positon, the teeth 104 and 138 remain enmeshed and thereby avoid any deleterious reactions had they been separated upon disablement of the rack 102 and re-enmeshed upon enablement thereof.

8 Claims, 5 Drawing Sheets

DOOR LATCH ASSEMBLY WITH RACK AND PINION ACTUATING MEMBERS

BACKGROUND OF THE INVENTION

This invention relates to a door latch assembly and particularly to a mechanism for disabling an actuator for a latch of the assembly when the door is locked while permitting free tactile operation of an outside door operator.

One type of commonly used latch assembly for a door contains an internal mechanism which is actuated by an outside operator such as, for example, a knob, a lever or a thumbpiece to withdraw and move the associated latch or bolt from a latched position to an unlatched position and thereby permit the opening of the door. The mechanism includes a rack and a pinion which are positioned in engagement so as to permit relative movement therebetween upon movement of the outside operator. This movement facilitates and controls the movement of the latch or bolt between latched and unlatched positions.

As illustrated and described in U.S. Pat. No. 2,021,565, a door latch assembly of this type includes a pinion which is connected to an external or outside lever handle to permit rotation of the pinion upon operation of the handle. A rack is positioned in meshing engagement with the pinion and is pivotally connected at one end to a bell crank lever which is also connected to a latch or locking bolt. When the handle is operated, the pinion rotates and drives the rack which, in turn, causes the bolt to move from the latched position to the unlatched position by virtue of pivotal movement of the bell crank lever.

If it is desired to lock the door latch, an internal or inside lever handle is moved from an unlocked position to a locked position to operate a linkage within the door latch assembly when the latch is in the latched position to pivot the rack away from and out of engagement with the pinion. Any subsequent movement of the outside lever handle will only result in rotation of the pinion but not in movement of the rack whereby the bolt remains and is locked in the latched position. When the inside handle is moved to the unlocked position, the linkage is manipulated to move the rack into meshing engagement with the pinion. The bolt can now be moved by operation of the outside handle.

When the latch is unlocked, the rack teeth mesh with the teeth of the pinion to reposition the rack and pinion for movement of the latch upon operation of the outside lever. If the teeth of the rack and pinion have become slightly misaligned during the period when they are separated, the teeth will not mesh smoothly. Due to the fragile nature of the teeth resulting from the physical size thereof and the materials used to form the rack and pinion, the misaligned meshing of the teeth could result in chipped or fractured teeth. Even when the teeth are of sufficient bulk and are composed of stronger materials, chipping or fracturing of the misaligned teeth could occur during re-meshing thereof.

In any event, this could eventually result in deficient operation, or complete lack of operability, of the door latch.

Additionally, if the pinion has been rotated to the operated position by operation of the outside handle at the same time that the inside lever is operated to move and return the rack into engagement with the pinion, the rack and pinion will be out of alignment by one or more teeth. In this condition, the outside handle will be in the operated position, that is pivoted downwardly, and will not return to the rest position. This will prevent normal and eventual depression of the outside lever downwardly to move the latch from the latched position to the unlatched position.

Further, if the pinion has been rotated while out of engagement with the rack to a position whereby the teeth of the rack and pinion are in interfacing alignment, when the rack is moved toward the pinion the teeth would not mesh but would move into butting engagement. This reaction will obviously render the actuating mechanism inoperable.

A similar rack and pinion actuating mechanism is also illustrated and described in U.S. Pat. No. 1,511,956.

Therefore, in view of the deficiency in a door latch having an actuating mechanism as set forth in the above-noted U.S. patents, there is a need for an actuating mechanism for a door latch which retains the operating components thereof in engagement even though the mechanism has been disabled during periods when the door latch is locked.

SUMMARY OF THE INVENTION

In view of the foregoing problem, it is an object of this invention to provide an improved door latch which avoids damage to a latch actuating mechanism when a locked latch is unlocked.

More specifically, it is an object of this invention to provide a door latch which has a latch actuating mechanism including components which are positioned relative to each other during all periods when the latch is locked so as to avoid damage to the components when the latch is unlocked.

With these and other objects in mind, this invention contemplates a door latch assembly which includes a latch encasement, a latch contained within the encasement which is movable between a latched position and an unlatched position; means for normally biasing the latch into the latched position; actuating means having at least two components in interacting engagement for moving the latch against the action of the biasing means from the latched position to the unlatched position, and means for disabling the actuating means while retaining the two components in interacting engagement to facilitate the locking of the latch in the latched position.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
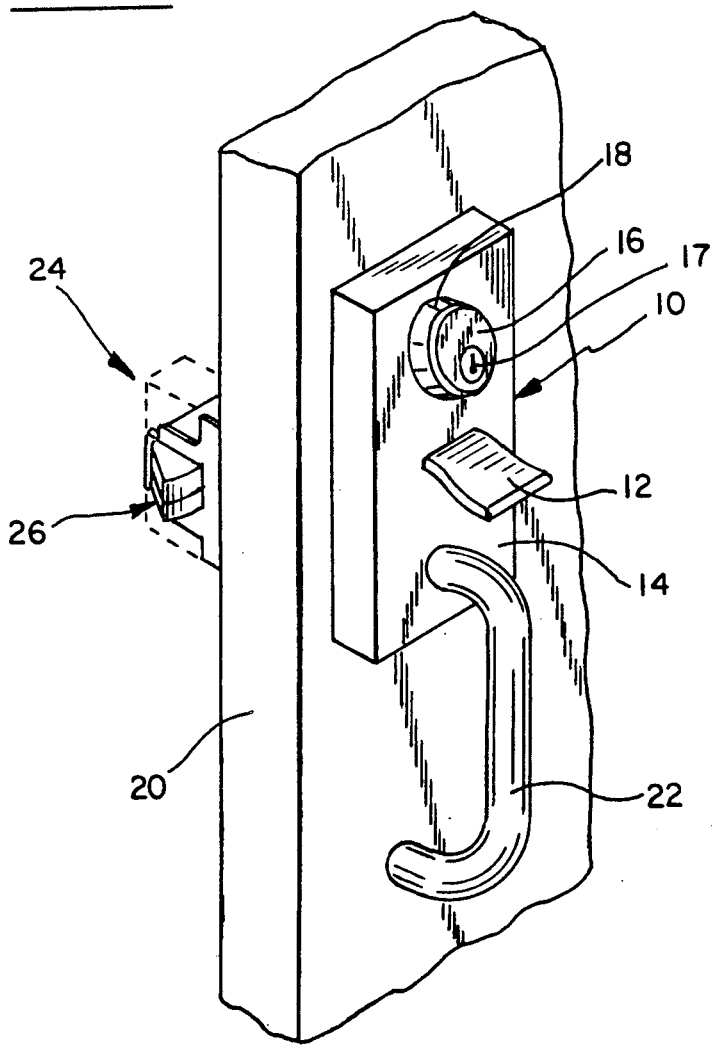
FIG. 1 is a perspective view showing a thumbpiece-operated door latch assembly as mounted on a door.

As illustrated in FIG. 1, the exterior of a door latch assembly 10 includes a latch operator such as a thumbpiece 12 which extends outwardly from an exterior surface of an escutcheon 14. An exterior portion of a lock cylinder 16 with a key slot 17 also extends from the exterior surface of the escutcheon 14 with a cylinder collar 18 located between a face of the cylinder 16 and the escutcheon. The escutcheon 14 is mounted to the outside or external face of a door 20. A handle 22 is attached at one end thereof to the escutcheon 14 and to the door 20 at the other end thereof. A housing and mounting facility 24 is mounted to the inside or internal face of the door 20 with a dual latch 26.

Figure 2:
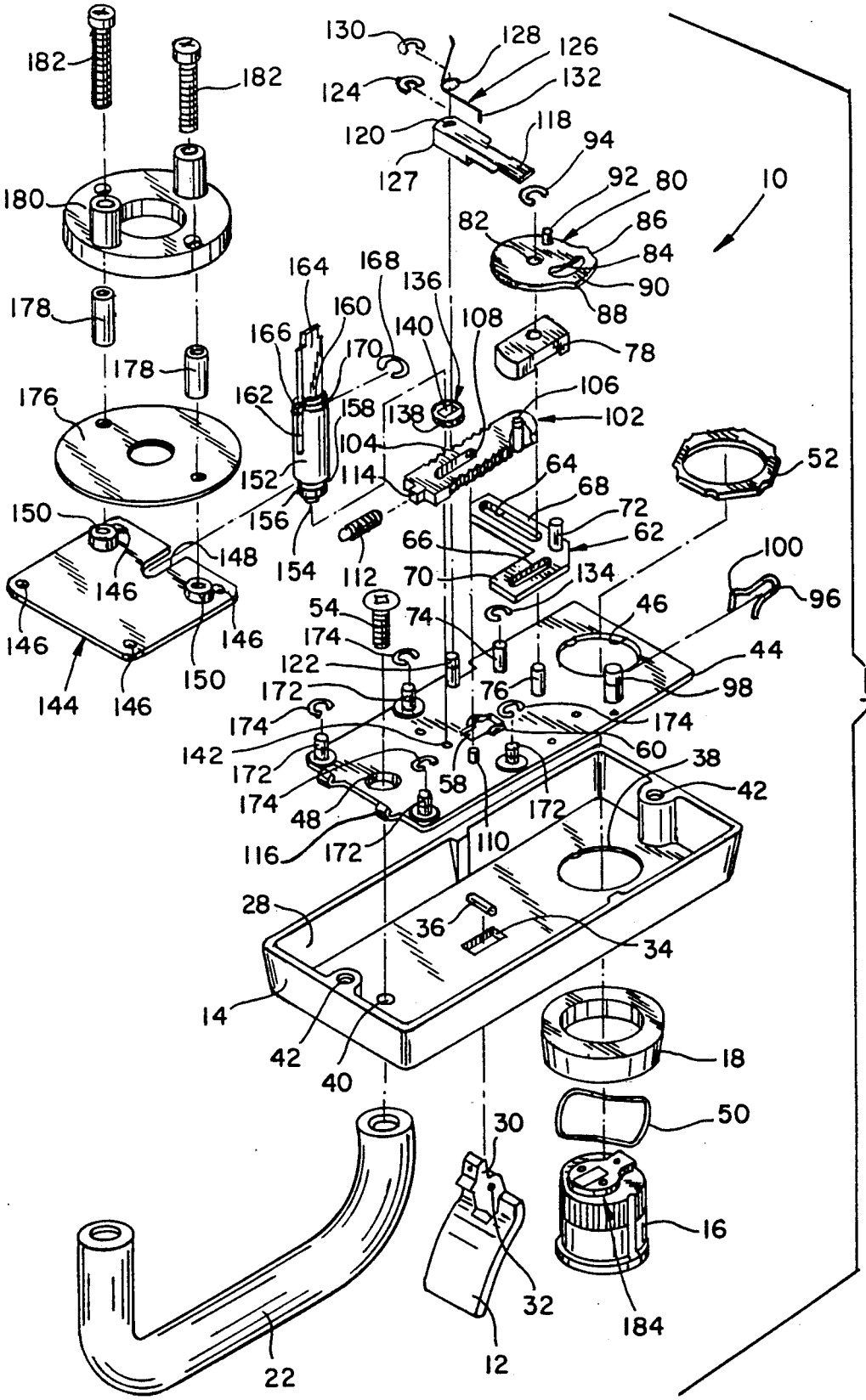
FIG. 2 is an exploded perspective view showing an internal latch actuating mechanism of a portion of the door latch assembly of FIG. 1 which embodies certain principles of the invention.

Referring to FIG. 2, the escutcheon 14 is formed on the interior thereof with a dish-like opening 28. The thumbpiece 12 is formed with an actuator ear 30 which is formed with a through hole 32 from one side to the other at the base of the ear. The escutcheon 14 is formed with a rectangular opening 34 through which the ear 30 of the thumbpiece 12 is located. With the through hole 32 now located within the dish-like opening 28 of the escutcheon 14, a pivot pin 36 is inserted through the through hole. Opposite ends of the pin are positioned to extend from opposite sides of the ear 30 and rest on the floor of the dish-like opening 28 thereby retaining the thumbpiece 12 with the escutcheon 14.

The escutcheon 14 is formed with an opening 38 to facilitate assembly of the lock cylinder 16 with the escutcheon and is also formed with another opening 40 to facilitate assembly of the handle 22 with the escutcheon. The escutcheon 14 is also formed with threaded apertures 42 to facilitate assembly of the escutcheon with the door 20.

A base plate 44 is inserted into the dish-like opening 28 and is formed with holes 46 and 48. Hole 46 is located adjacent and aligned with hole 38 while hole 48 is located adjacent and aligned with hole 40. A collar spring 50 and the collar 18 are assembled over and onto lock cylinder 16 which is then inserted through aligned holes 38 and is secured to the escutcheon 14 by nut 52. A screw 54 is positioned through openings 40 and 48 and is threadedly mounted within threaded aperture 56 at one end of handle 22 to retain the handle with the escutcheon 14.

The base plate 44 is formed with a rectangular opening 58 which is adjacent and aligned with aperture 34. The ear 30 extends through opening 58. Grooved retaining bridges 60 are formed in base plate 44 on opposite sides of opening 58 and are positioned over the ends of pin 36 to capture the ends between the bridges and the floor of the dish-like opening 28 of the escutcheon 14. In this manner, thumbpiece 12 is mounted for pivoting movement relative to escutcheon 14 and about the axis of pin 36.

An L-shaped locking plate 62 has two slots 64 and 66 formed in legs 68 and 70, respectively, thereof, with a pin 72 extending from one face thereof. The locking plate 62 is located with respect to base plate 44 so that a pair of pins 74 and 76, which are mounted on the base plate, extend through opposite ends of slot 64. A spacer 78 is formed with an aperture which is positioned over pin 76 and atop a portion of leg 68 of plate 62. A locking lever 80 is formed with a central hole 82, an arcuate follower slot 84 and a pair of spaced depressions 86 and 88 formed on an eccentric lobe 90. In addition, a pin 92 is supported on and extends from one face of the lever 80.

The locking lever 80 is positioned on top of the spacer 78 with the hole 82 being positioned over pin 76. A retaining ring 94 is secured to the free end of pin 76 to retain the elements mounted thereon in the assembled relation as described above.

A stop spring 96 is positioned on a pin 98 which is mounted on base plate 44 and is formed with a curved end 100 located to engage depressions 86 and 88. This provides a biasing force to stop rotation of locking lever 90 in either one of two positions associated with depressions 86 and 88. The biasing force of stop spring 96 can be overcome with a light application of counter rotational force applied to locking lever 90.

A rack 102 is formed with a plurality of teeth 104 along an edge thereof and supports a pin 106 which extends through the top and bottom of the rack as shown in FIG. 2. A slot 108 is formed in an intermediate portion of the rack 102.

Rack 102 is positioned with respect to base plate 44 so that slot 108 is located over a pin 110 which extends from the base plate and so that the lower end of pin 106 is positioned within slot 66 of L-shaped locking plate 62. An extension spring 112 is attached at one end thereof to one end 114 of rack 102 and is attached at the other end thereof to an attachment tab 116 (FIGS. 6 and 7) of base plate 44.

An actuator arm 118 is formed with a hole 120 at one end thereof which is positioned over a pin 122 mounted on base plate 44 to facilitate pivoting movement of the actuator arm. An intermediate portion of one edge of arm 118 is positioned for engagement with thumbpiece ear 30. The opposite edge of arm 118, toward the free end thereof, is positioned to engage the upper end of rack pin 106. A retaining ring 124 is positioned onto pin 122 to retain arm 118 with the pin. An actuator spring 126 includes a coiled portion 128 which is positioned over the end of pin 122 which is then capped with another retaining ring 130. One free end 132 of spring 126 is formed with a ninety degree bend which is positioned within a small aperture 127 formed in the top face of the arm 118 as shown in FIG. 2. The other end of spring 126 is positioned to the inside of pin 74 which is then capped with a retaining ring 134.

With spring 126 mounted as described above, actuator arm 118 is normally biased and urged against thumbpiece ear 30 whereby thumbpiece 12 extends generally perpendicularly from the exterior of escutcheon 14 as viewed in FIG. 1.

Referring again to FIG. 2, a pinion 136 is formed with teeth 138 about the periphery thereof and is positioned on base plate 44 so that the pinion teeth mesh with rack teeth 104. Pinion 136 is formed with an elongated slot 140 which is positioned centrally over an aperture 142 formed in the base plate 44.

A cassette plate 144 is formed with holes 146 at the four corners thereof and with a slot 148 along one edge thereof. Also, a pair of threaded nuts 150 are mounted on plate 144 near the corners of the plate common to the edge which has slot 148 formed therein.

A spindle 152 is formed at one end with a pin-like extension 154 which conforms to the size and shape of base plate aperture 142. The spindle 152 is formed with an oblong section 156 adjacent to the pin-like extension 154 where the oblong section conforms to the size and shape of pinion slot 140. Further, pinion 152 is formed with an annular groove 158 adjacent oblong section 156 and conforms to the size of slot 148 of cassette plate 144.

Spindle 152 is formed with an aperture 160 and slots 162 (one shown). A compression spring (not shown) is positioned within aperture 160. One end of a blade 164 is formed with T-shaped cross arms 166 (one shown) which is inserted within aperture 160 behind the compression spring so that the cross arms extend radially outwardly from the slots 162. A retaining ring 168 is positioned within an annular groove 170 of spindle 152 above the cross arms 166 to retain the blade 164 in spring biased assembly with the spindle.

Cassette plate 144 is positioned so that slot 148 is located about spindle groove 158. This assembly is then positioned in assembly with base plate 44 so that holes 146 of the cassette plate 144 are located over pins 172 which are then capped with retaining rings 174.

As the cassette plate 144 and spindle 152 are moved into assembly position with base plate 44, the pin-like extension 154 is moved into the elongated slot 140 of pinion 136 and into base plate aperture 142. Also, oblong extension 156 of spindle 152 is moved into the elongated slot 140 of pinion 136. In this manner, pinion 136 is now accurately located and held with base plate 44 for rotational movement relative thereto. Also, pinion 136 is now positioned in driving engagement with spindle 152 so that, upon rotation of the pinion, the spindle will also rotate.

A reinforcement plate 176, spacers 178 and adapter ring 180 are mounted to cassette plate 144 by use of screws 182 and nuts 150 which are secured to the cassette plate as noted above. This assembly provides a supporting structure within door 20 for mounting the door latch assembly 10 to the door.

The inside end of the lock cylinder 16 supports for rotation thereon a camming element 184 which is formed with an eccentric lobe 186. Opposite side edges of the lobe 186 are positioned to be movable into engagement with pin 92 of locking lever 80.

Figure 4:
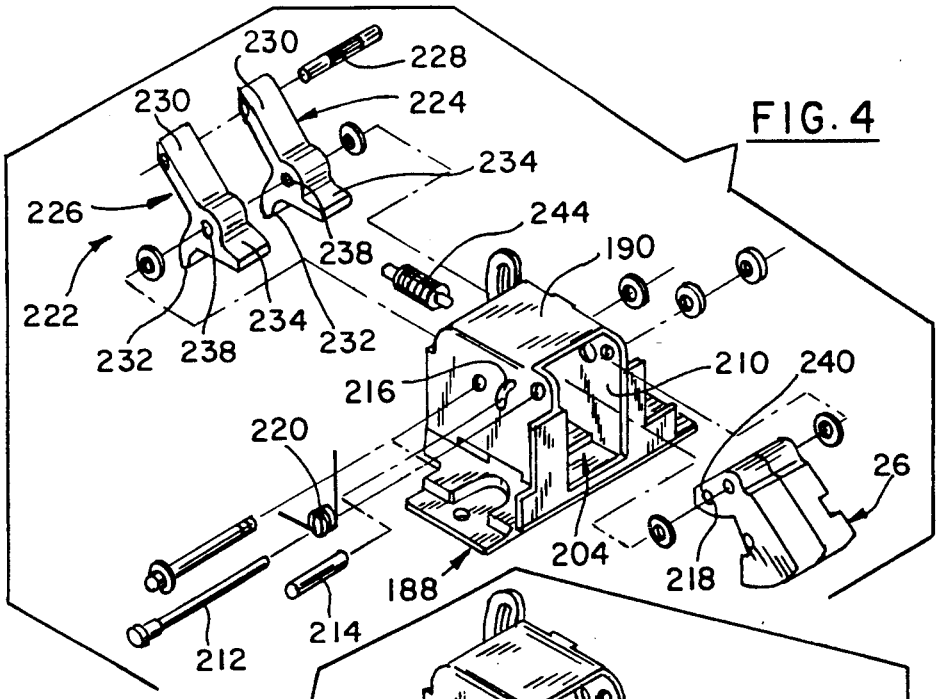
FIG. 4 is a partially exploded perspective view showing a housing and mounting facility for containing a latch or locking bolt of the door latch assembly of FIG. 1.
Figure 5:
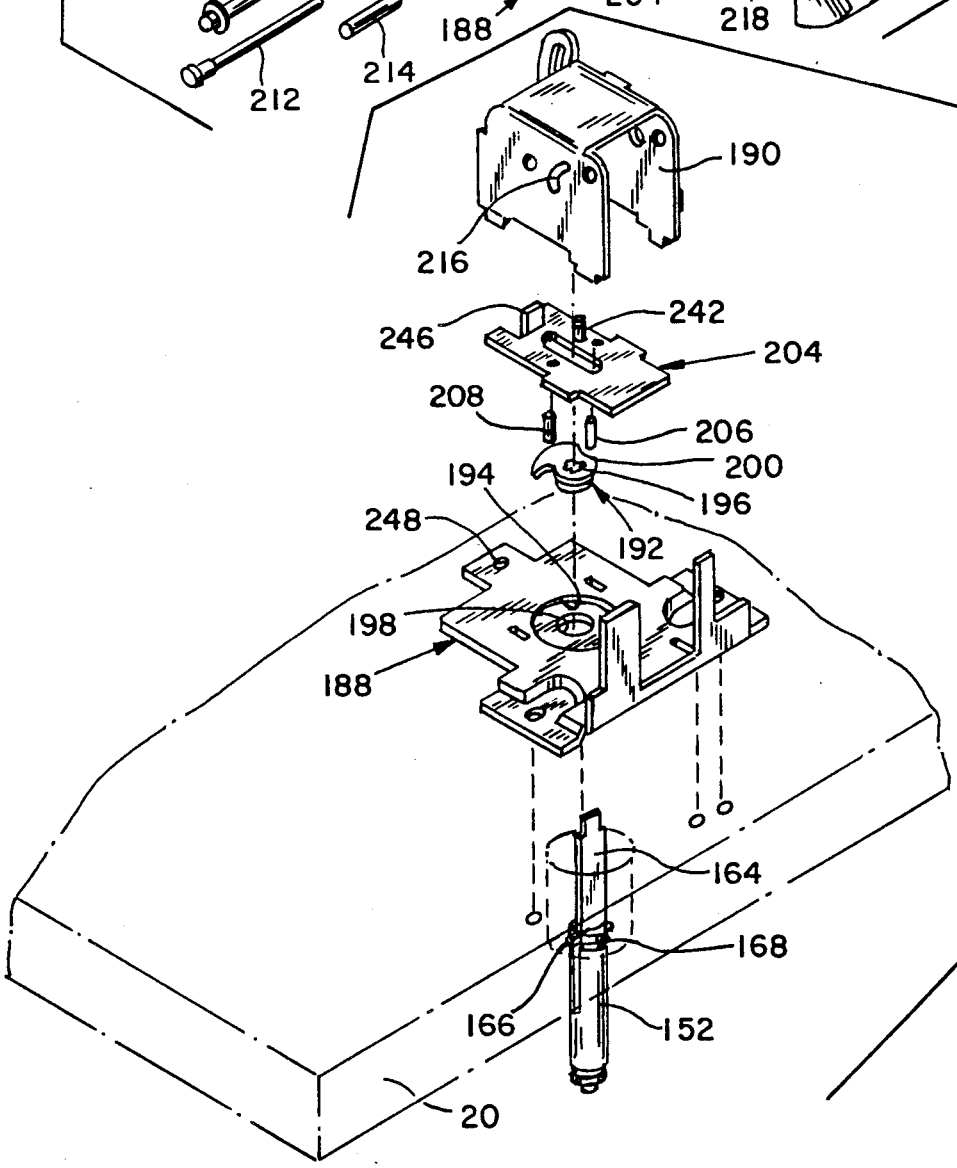
FIG. 5 is an exploded perspective view of the housing and mounting facility of FIG. 4 in position for assembly with the door.

Referring now to FIGS. 4 and 5, the housing and mounting facility 24 for dual latch 26 includes a plate and frame unit 188 which provides a foundation and support for a housing cover 190. A center key receptor 192 (FIG. 5) is positioned within a nest 194 formed in the unit 188 and is retained within the unit. A cross slot 196 of the receptor 192 is exposed through an opening 198 formed centrally in the nest 194. Receptor 192 is formed with a pair of spaced arcuate camming surfaces 200 and 202.

An actuator slide 204 is mounted on the floor of unit 188 so that the receptor 192 is sandwiched between the slide and nest 194. A pair of pins 206 and 208 are mounted on the underside of the slide 204 and are located within the arcuate spaces formed by camming surfaces 200 and 202, respectively.

Spindle 152 is positioned within an opening of door 152 and is located so that the free end of blade 164 is inserted into cross slot 196. Thus, as the spindle 152 is rotated, receptor 192 is rotated in one direction or the other whereby one of the camming surfaces 200 or 202 engages one of the pins 206 and 208, respectively, to move the slide 204 along the floor of unit 188.

In the complete assembly as illustrated in FIG. 4, the dual latch 26 is positioned within an opening 210 of the housing cover 190. A latch shaft 212 is then positioned to retain the dual latch 26 for pivotal movement within facility 24. A roll pin 214 projects through an arcuate slot 216 in the side of cover 190 and is inserted into an aperture 18 formed in dual latch 26. A latch spring 220 is positioned on shaft 212 and has one end thereof pressing against the portion of roll pin 214 to provide a means for normally urging the dual latch 26 in the extended latched position as illustrated in FIG. 1.

Referring again to FIG. 4, a lever unit 222 is formed by a pair of levers 224 and 226 which are held together by a drive pin 228. Each of the levers 224 and 226 is formed in a bell crank configuration with legs 230 and 232 and further includes an actuator ear 234. Lever unit 222 is inserted into an opening of cover 190 at the end opposite opening 210. A shaft 236 is then inserted through openings in cover 190 and through openings 238 of the levers 224 and 226 to retain the lever unit 222 for pivotal movement within the facility 24.

As the lever unit 222 is positioned within the opening of cover 190, ears 234 are located adjacent the underside of ears 240 of dual latch 26.

Slide 204 is then inserted into the same opening of cover 190 as lever unit 222 was inserted and is positioned beneath the lever unit on the floor unit 188 as described above with pins 206 and 208 (FIG. 5) being located with respect to receptor 192 also as described above. In this position, a pin 242 (FIG. 5) mounted on slide 204 is located behind leg 232 of lever 224. A coil spring 244 is attached at one end thereof to a tab 246 (FIG. 5) of slide 204 and at the other end to a tab 248 which is attached to an extension 250 of unit 188.

As blade 164 is rotated, receptor 192 is rotated to engage either pin 206 or 208 and move slide 204 toward dual latch 26 and against the biasing action of spring 244. As the slide 204 is moved, pin 242 engages the rear of leg 232 and pivots ears 234 of lever unit 222 upwardly against the underside of latch ear 240. In this manner, dual latch 26 is pivoted to retract the latch within opening 210 whereby the latch is moved from the latched position to the unlatched position.

Figure 3:
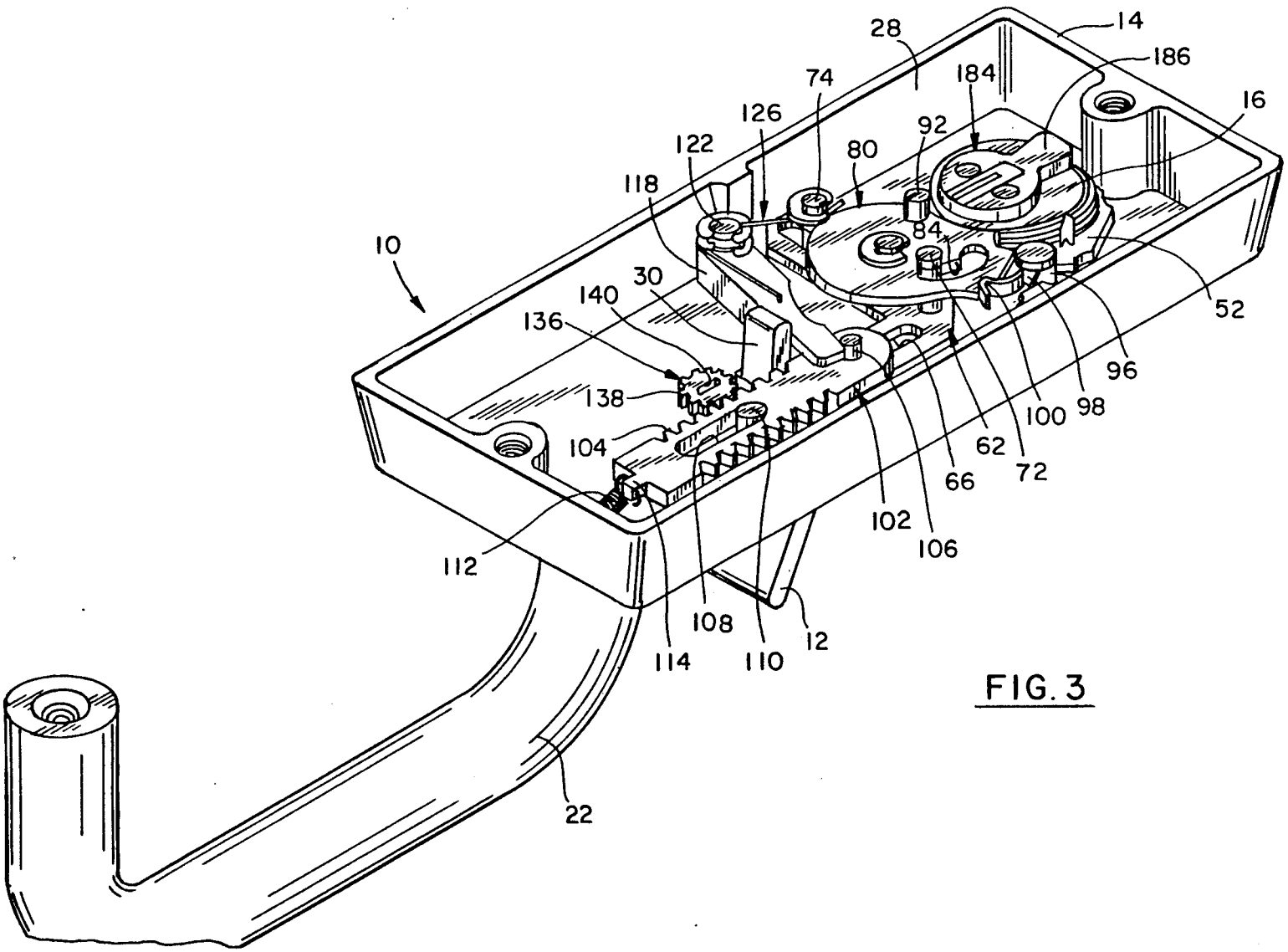
FIG. 3 is a perspective view with portions exposed showing the assembly of the internal latch actuating mechanism of FIG. 2 embodying certain principles of the invention.

In operation of the door latch assembly 10, the dual latch 26 is in the latched position and is biased by a means such as latch spring 220 into a strike (not shown) and accommodating strike slot when the door 20 is in the closed position. At that time, an actuating means which includes at least two interacting components such as, for example, rack 102 and pinion 136 is in a deactuated position as illustrated in FIG. 3. If it is desired to open the door 20, thumbpiece 12 (FIGS. 1 and 3) is depressed to move actuator ear 30 into engagement with actuator arm 118 which then pivots against the biasing action of spring 126.

Figure 6:
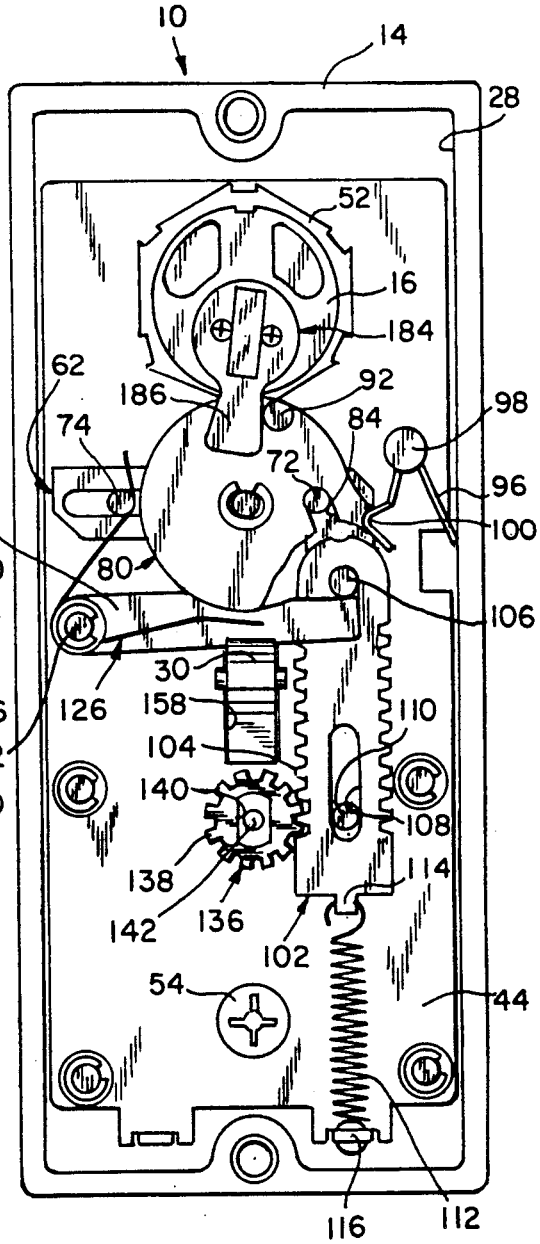
FIG. 6 is a front view showing the internal latch actuating mechanism of FIG. 2, which embodies certain principles of the invention, in an actuated position for moving the latch from a latched position to an unlatched position.

As actuator arm 118 is pivoted, the arm engages the top of pin 106 and moves the rack 102 to the position illustrated in FIG. 6. During the period when the rack 102 is being moved, pinion 136 is being rotated by virtue of the meshing of teeth 104 and 138 of the rack and pinion, respectively. Rotation of the pinion 136 causes rotation of spindle 152 and blade 164 (FIGS. 2 and 5) whereby receptor 192 is also rotated. As described above, this results in the dual latch 26 being moved from the latched position within the strike to the unlatched position outside of the strike whereafter the door 20 can be opened.

When the door 20 is opened and the thumbpiece 12 is released, arm 118 returns to the position illustrated in FIG. 3 under the action of spring 126. Further, since the arm 118 has been withdrawn from engagement with pin 106, rack 102 returns to the position illustrated in FIG. 3 under the action of spring 112. This causes pinion 136 to rotate in the reverse direction whereby spindle 152 and blade 164 are rotated which results in the dual latch 26 being returned to the latched position. Upon closure of the door 20, dual latch 26 is operated in the conventional manner upon engagement with the strike whereby the latch is in the latched position when the door is closed.

When it is desired to lock the door 20 through the door latch assembly 10, a key (not shown) is inserted into key slot 17 (FIG. 1) of lock cylinder 16. Upon turning of the key, camming element 184 rotates clockwise from the position illustrated in FIG. 6 to the position illustrated in FIG. 7. As camming element 184 is rotated, eccentric lobe 186 engages pin 92 and moves the pin from the position illustrated in FIG. 6 to the position in FIG. 7. During movement of pin 92, locking lever 80 is rotated whereby pin 72 of L-shaped locking plate 62 is moved by virtue of its positioning within follower slot 84. As pin 72 is moved, L-shaped locking plate 62 is moved to the right from the position illustrated in FIG. 6 to that illustrated in FIG. 7. During positioning of locking lever 80 as noted above, stop spring 96 cooperates with depressions 86 and 88 of the locking lever to establish a biasing force at the opposite ends of travel of the lever.

Figure 7:
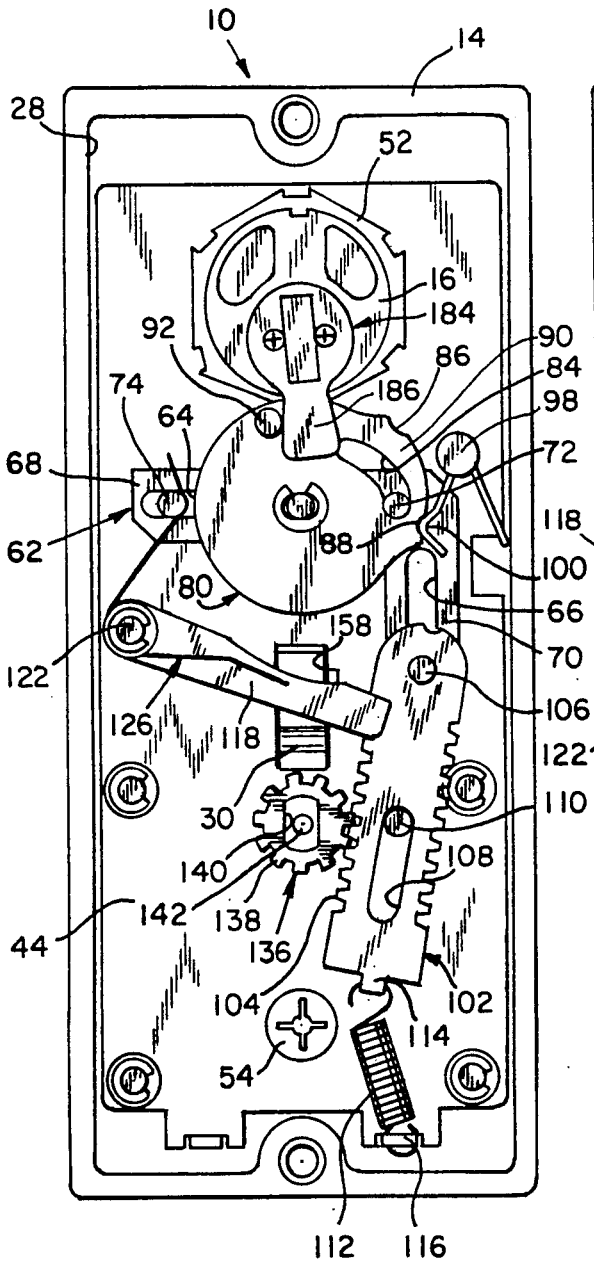
FIG. 7 is a front view showing the internal latch actuating mechanism of FIG. 2, which embodies certain principles of the invention, in a disabled position.

Since the lower end of rack pin 106 is positioned in slot 66 of plate 62, the rack 102 is moved at the pin end thereof from the position of FIG. 6 to that of FIG. 7. Further, pin 110 which is mounted to base plate 44 is located within rack slot 108 so that, upon movement of the pin end of the rack 102 as described above, the rack actually rotates about pin 110. Thus, the spring end of the rack 102 moves from the position of FIG. 6 to that of FIG. 7.

With rack 102 in the position as illustrated in FIG. 7, the top of pin 106 has been moved out of the path of movement of actuator arm 118. When thumbpiece 12 is thereafter depressed, ear 30 will move the arm 118. However, since pin 106 has been moved, the arm 118 will not engage the pin and the actuating means which includes the rack 102 and the pinion 136 is disabled. Therefore, the dual latch 26 cannot be moved from the latched position to the unlatched position and the door latch assembly 10 is locked.

While the door latch assembly 10 is in the locked condition, thumbpiece 12 still can be depressed with the resultant biased movement of the arm 118. The operation of the thumbpiece presents a tactile perception to the user that the actuating means is being operated when, in fact, it is not. Also, since the thumbpiece 12 and ear 30 effectively have been disconnected from the rack 102 and pinion 136, it is unlikely that forced entry through door 20 can be made by hammering on thumbpiece 12 in an attempt to destroy or damage the door latch assembly 10.

As noted above, the teachings of U.S. Pat. Nos. 1,511,956 and 2,021,565 is to move the rack away from the pinion so that operation of either will not result in operation of the other. Typically, the rack 102 and pinion 136 of the present invention are composed of a powdered metal such as, for example, powdered nickel steel. While such powdered metal products are capable of performing in the normal context for which they are designed, they are easily fractured or chipped if subjected to abnormal stresses such as will occur when meshing teeth are misaligned. Such misalignment can occur with the systems of illustrated in U.S. Pat. Nos. 1,511,956 and 2,021,565 as noted above.

Thus it becomes extremely important in the continued utilization of door latch assembly 10 that the two components, such as rack 102 and pinion 136, of the actuating means be retained in engagement while the actuating means is disabled. The disabling means described above, which includes pin 110 located within rack slot 108, facilitates the positioning of rack 102 so that the rack cannot be moved upon depression of thumbpiece 12. This is accomplished by locating the axis of the pinion 136 in horizontal alignment with the axis of pin 110 so that the teeth 104 of rack 102 are, in effect, rolled partially and slightly around adjacent teeth 138 of the pinion as the rack is rotated about the axis of pin 110. This permits the rack teeth 104 and the pinion teeth 138 to remain enmeshed when disabling the actuating means. Since the teeth 104 and 138 remain enmeshed, there is no opportunity for damage, misalignment or any other deleterious results which could occur had the teeth been separated and then later enmeshed. When the key is used to unlock the door latch assembly 10, the process is reversed and the rack 102 returns to the position illustrated in FIG. 6 while the rack teeth 104 and the pinion teeth 138 remain enmeshed.

While the above-described embodiment is directed to a thumbpiece-controlled door latch assembly with a latch unit mounted outside the door, other types of latch assemblies could utilize the above-described principle. For example, door latch assemblies with a knob, lever or other type of door latch operators could be used with above-described mechanism of the present invention. Also, mortise or other type latch units could also be used with the above described mechanism of the present invention. Further, door latch assemblies which employ at least two interacting components in the actuation of the latch and which are separated when disabled could also take advantage of the present invention where there is opportunity for misalignment when they are again enabled.

In general, the above described embodiment is not to be construed as limiting the breadth of the present invention. Modifications, and other alternative constructions, will be apparent which are within the spirit and scope of the invention as defined in the appended claims.

What is claimed is:

1. A door latch assembly, which comprises:

a latch encasement;

a latch contained within the encasement which is movable between a latched position and an unlatched position;

means for normally biasing the latch into the latched position;

a housing;

a rack having teeth formed thereon and mounted for movement in the housing;

a pinion having teeth formed thereon and positioned for meshing engagement with the teeth of the rack; the pinion mounted for rotation in the housing;

an actuator arm located in the housing and positioned to engage and move the rack upon selective operation thereof whereby the pinion is rotated;

means attached to the pinion for translating motion of the pinion to the latch to move the latch from the latched position to the unlatched position.

means for maintaining the teeth of the rack in engagement with the teeth of the pinion at a defined location in the housing;

means for moving the rack away from the actuator arm to prevent movement of the rack upon subsequent operation of the arm; and the maintaining means continuing to maintain the teeth of the rack in engagement with the teeth of the pinion subsequent to movement of the rack by the moving means.

2. The door latch assembly as set forth in claim 1, wherein the maintaining means includes:

a first pin fixedly mounted in the housing;

a second pin mounted in the housing at a location spaced from the first pin;

the rack mounted on the first pin for movement relative thereto;

the rack teeth being in meshing engagement with the pinion teeth at the defined location between the first pin and the second pin; and means for permitting linear movement of the rack adjacent the pinion to rotate the pinion and for permitting the rack to be moved out of the path of the actuator arm while maintaining teeth enmeshing engagement with the pinion at the defined location.

3. The door latch assembly as set forth in claim 2, wherein the permitting means includes a slot formed in the rack which receives the first pin therein.

4. The door latch assembly as set forth in claim 2, which further comprises:

a locking plate;

means for coupling the rack to the locking plate so that the rack can move with the plate or independently of the plate;

means for maintaining the locking plate in a precise position when the door latch assembly is in an unlocked condition to permit the rack to move independently of the plate and linearly upon operation of the actuator arm and thereby facilitate movement of the latch from the latched position to the unlatched position, and means for moving the locking plate when the door latch assembly is placed in the locked condition whereby the coupling means facilitates movement of the rack with the locking plate to position the rack away from the actuator arm and thereby preclude movement of the rack upon operation of the actuator arm.

5. The door latch assembly as set forth in claim 4, wherein the means for moving the locking plate includes:

a locking lever;

means for selectively operating the locking lever when it is desired to lock the door latch assembly, and means for coupling the locking lever to the locking plate so that upon selective operation of the operating means the locking plate is moved to move the rack away from the path of engagement with the actuator arm.

6. A door latch assembly, which comprises:

a latch encasement;

a latch contained within the encasement which is movable between a latched position and an unlatched position;

means for normally biasing the latch into the latched position;

actuating means having at least two components in interacting engagement for moving the latch against the action of the biasing means from the latched position to the unlatched position;

wherein the two components of the actuating means are comprised of a rack having teeth formed thereon and a pinion having teeth formed thereon and enmeshed with the teeth of the rack;

means for disabling the actuating means while retaining the two components in interacting engagement to facilitate the locking of the latch in the latched position; and wherein the disabling means includes:

means for moving the rack to a position where the rack cannot be enabled to facilitate unlatching movement of the latch, and means for retaining the rack teeth in enmeshed engagement with the pinion teeth during disablement of the actuating means.

7. A door latch assembly, which comprises:

a latch encasement;

a latch contained within the encasement which is movable between a latched position and an unlatched position;

means for normally biasing the latch into the latched position;

actuating means having at least two components in interacting engagement for moving the latch against the action of the biasing means from the latched position to the unlatched position;

means for disabling the actuating means while retaining the two components in interacting engagement to facilitate the locking of the latch in the latched position, and wherein the actuating means includes:

means positioned for engagement with a first component of the two components for moving the first component upon selective operation thereof to move the latch from the latched position to the unlatched position;

means for mounting the first component for movement relative to a first fixed axis;

means for mounting a second component of the two components for movement relative to a second fixed axis spaced from the first fixed axis;

the first component being in interacting engagement with the second component at a location between the first fixed axis and the second fixed axis, and wherein the disabling means includes:

means for positioning the first component to prevent engagement thereof by the first-component moving means and thereby preclude movement of the latch from the unlatched position, and means for maintaining the first component and the second component in interacting engagement between the first fixed axis and the second fixed axis when the first component is positioned out-of-engagement with the first-component moving means.

8. The door latch assembly as set forth in claim 7, wherein the maintaining means includes the first mounting means and the second mounting means which cooperate to continue to maintain the first component and the second component in interacting engagement during disablement of the actuating means.

* * * * *